US009580211B2

(12) United States Patent
Kirsh

(10) Patent No.: US 9,580,211 B2
(45) Date of Patent: Feb. 28, 2017

(54) CHILD-RESISTANT RESEALABLE PLASTIC BAG SLIDER SYSTEM

(71) Applicant: Ross Kirsh, New York, NY (US)

(72) Inventor: Ross Kirsh, New York, NY (US)

( * ) Notice: Subject to any disclaimer, the term of this patent is extended or adjusted under 35 U.S.C. 154(b) by 153 days.

(21) Appl. No.: 14/581,079

(22) Filed: Dec. 23, 2014

(65) Prior Publication Data

US 2016/0001930 A1 Jan. 7, 2016

Related U.S. Application Data

(60) Provisional application No. 62/021,258, filed on Jul. 7, 2014.

(51) Int. Cl.

*B65D 33/25* (2006.01)
*A44B 19/30* (2006.01)
*B65D 33/34* (2006.01)

(52) U.S. Cl.

CPC ..... *B65D 33/2591* (2013.01); *B65D 33/34* (2013.01); *A44B 19/303* (2013.01); *B65D 2101/00* (2013.01); *B65D 2215/02* (2013.01); *Y10T 24/158* (2015.01); *Y10T 24/2509* (2015.01)

(58) Field of Classification Search

CPC ... A44B 19/303; A44B 19/30; A44B 24/2561; Y10T 24/158; Y10T 24/15; Y10T 24/2509; Y10T 24/2534; B65D 33/2591; B65D 33/34; B65D 33/2566; B65D 2215/02

See application file for complete search history.

(56) References Cited

U.S. PATENT DOCUMENTS 5,007,143 A * 4/1991 Herrington ..... B65D 33/2591 24/399
6,376,035 B1 * 4/2002 Dobreski ..... B65D 33/2591 383/64
6,385,818 B1 * 5/2002 Savicki, Sr. ..... B65D 33/2591 24/30.5 R
7,506,417 B2 * 3/2009 Yoneoka ..... A44B 19/301 24/386
8,893,356 B2 * 11/2014 Ozaki ..... B65D 33/2591 24/415

(Continued)

*Primary Examiner* — Robert J Sandy

(74) *Attorney, Agent, or Firm* — Antonio Papageorgiou; Meister Seelig & Fein LLP

(57) ABSTRACT

A container sealing system and a container feature are disclosed. The container sealing system includes one or more seals encompassing a container opening, wherein the one or more seals are interlockable or otherwise engageable to seal the container when activated; a first slider head including a male fitting coupled to the one or more seals; and a second slider head coupled to the one or more seals and opposing the first slider head, and including a female fitting for receiving and coupling the male fitting. Actuation of at least one of the slider heads such that the male fitting contacts the female fitting couples the one or more seals encompassing the container opening, sealing the container. The container sealing system may be child-resistant, may be resealable, and/or may include a tamper-indicating feature. The container including the container sealing system may be used for containing, storing, or transporting materials that are not suitable for handling or consumption by a child.

19 Claims, 17 Drawing Sheets

(56) References Cited

U.S. PATENT DOCUMENTS

| | | | | |
|---|---|---|---|---|
| 2003/0014848 | A1* | 1/2003 | LaRue | A44B 19/267 24/387 |
| 2004/0161169 | A1* | 8/2004 | Fenzl | B31B 19/90 24/400 |
| 2014/0311101 | A1* | 10/2014 | Petkovsek | B65D 33/2591 24/382 |
| 2014/0311102 | A1* | 10/2014 | Petkovsek | B65D 33/2591 53/481 |
| 2016/0088906 | A1* | 3/2016 | Jin | A44B 19/303 24/30.5 L |

* cited by examiner

CHILD-RESISTANT RESEALABLE PLASTIC BAG SLIDER SYSTEM

CROSS-REFERENCE TO RELATED APPLICATIONS

This application claims priory to U.S. Provisional Patent Application No. 61/920,156, filed on Dec. 23, 2013, and U.S. Provisional Patent Application No. 62/021,258, filed Jul. 7, 2014, the disclosures of which are incorporated herein by reference in their entirety.

BACKGROUND OF THE INVENTION

The present application relates generally to sealing systems for containers, and resealable containers comprising sealing systems. The sealing systems and resealable containers may further comprise a tamper-indicating feature. In certain embodiments, these sealing systems and resealable containers may be child-resistant and/or may be used to hold contents not suitable for consumption or handling by children.

A variety of products exist for containing, storing, or transporting items, materials, and substances. Flexible, e.g., plastic, bags, especially those with sealable and resealable openings, are particularly useful products that are widely available. Sealing systems for resealable plastic bags often include interlocking structures on opposing sides of a plastic bag opening, which can be coupled together by pressing them together, or using a slider coupled to the interlocking structures as described, for example, in U.S. Pat. No. 7,029,178. These systems, however, are easily opened and therefore not child resistant. Moreover, these systems do not indicate if the system has been tampered with (opened previously). Accordingly, these systems limit the usefulness of bags using such systems.

A need exists therefore for resealable bags that are tamper-indicating and/or are child-resistant. Such a container would be especially desirable in cases where items, materials, or substances not suitable for consumption or handling by children, such as medications, are to be stored, transported, or otherwise contained in a container.

BRIEF SUMMARY OF THE INVENTION

In one illustrative embodiment of the invention, there is provided a container sealing system that includes: one or more seals encompassing a container opening, wherein the one or more seals are engageable to couple together to seal at least a portion of the container when activated; a first slider head comprising a first fitting coupled to the one or more seals; and a second slider head comprising a second fitting coupled to the one or more seals and opposing the first slider head, wherein the first and second fittings interlock to prevent the first and second slider heads from moving away from each other lengthwise along the one or more seals; wherein actuation of at least one of the slider heads such that the first fitting interlocks with the second fitting couples the one or more seals encompassing the container opening, thereby sealing the container when in a locked orientation; and wherein at least one of the first and second slider heads are slidingly coupled to the one or more seals.

In at least one embodiment, coupling of the first fitting to the second fitting is a reversible coupling, and the container sealing system is a resealable container sealing system.

In at least one embodiment, the container sealing system further includes a tamper indicating feature which indicates an opening of the container event.

In at least one embodiment, at least one of the fittings is a male fitting comprising at least one barb that interlocks with a corresponding female fitting.

In at least one embodiment, at least one of the slider heads comprises an elongated structure, and wherein the other of the slider heads is fixed at one end of the container opening, and wherein the elongated structure is dimensioned sufficiently to cover the opening in the container when in the locked orientation.

In at least one embodiment, the slider head with the elongated structure has a lengthwise slot therein that receives the one or more seals of the container.

In at least one embodiment, the elongated structure further comprises a plurality of connecting terminals that retain the slider head with the elongated structure in sliding engagement to the one or more seals of the container.

In at least one embodiment, at least one of the connecting terminals extends along a length of the slider head with the elongated structure.

In at least one embodiment, the at least one connecting terminals is essentially parallel to the slot in the slider head with the elongated structure.

In at least one embodiment, the slider head with the elongated structure comprises at least one sealant member located within the slot of the elongated structure.

In at least one embodiment, the at least one sealant member has a wedge shape that extends lengthwise along the elongated structure.

In at least one embodiment, the slider head with the elongated structure comprises a plurality of sealant members that extend lengthwise along the elongated structure.

In at least one embodiment, the plurality of sealant member are essentially parallel to each other.

In at least one embodiment, the plurality of sealant members define a narrower lengthwise entry into the slot.

In at least one embodiment, the container is a flexible bag.

In another aspect, a container sealing system is provided that includes: one or more seals encompassing a container opening, wherein the one or more seals are engageable to couple together to seal at least a portion of the container when activated; a first slider head comprising a first fitting coupled to the one or more seals; and a second slider head comprising a second fitting coupled to the one or more seals and opposing the first slider head, wherein the first and second fittings reversibly interlock to prevent the first and second slider heads from moving away from each other lengthwise along the one or more seals; wherein at least one of the fittings is a male fitting comprising at least one barb that interlocks with a corresponding female fitting; wherein at least one of the slider heads comprises an elongated structure having a lengthwise slot therein that receives the one or more seals of the container and a plurality of connecting terminals that retain the slider head with the elongated structure in sliding engagement to the one or more seals of the container, and the other of the slider heads is fixed at one end of the container opening, and wherein the elongated structure is dimensioned sufficiently to cover the opening in the container when in the locked orientation; wherein actuation of at least one of the slider heads such that the first fitting interlocks with the second fitting couples the one or more seals encompassing the container opening, thereby sealing the container when in a locked orientation; and wherein at least one of the first and second slider heads are slidingly coupled to the one or more seals.

DETAILED DESCRIPTION OF THE INVENTION

Described herein is a container sealing system, a sealable container comprising the container sealing system, and a use of the sealable container. It will be appreciated that the following description is intended to be illustrative of embodiments of container sealing systems, sealable containers and uses thereof and is not intended to be limiting.

In certain non-limiting embodiments, the container to which the sealing system is applied or integrated thereto may be any suitable container with at least one opening and at least one compartment. In one embodiment, the container may be a plastic bag, a plastic container, or a container or bag composed of another suitable material including but not limited to water-tight or air-tight material, mesh, paper or composite material. In one embodiment, the container may comprise one or more openings, and may further comprise a sealing system on one or more or all of the openings.

In certain non-limiting embodiments, the container sealing system may comprise one or more seals located at a container opening. The sealing system may be any suitable system for sealing an opening as will be known to those of skill in the art, for example a zip-lock interlocking seal, or a seal that otherwise interlocks, engages, couples, or joins an opening together so as to close the opening. It will be appreciated that reference herein to the term "close" includes the sealing of the opening and encompasses both water tight and air tight seals.

In a further embodiment, the container sealing system may comprise two or more slider heads coupled to the seal at the container opening. The slider heads may each comprise one or more joinable fittings, e.g., adapters, hooks, teeth, clips, snaps, barbs, or any other structure(s), such as a friction fit coupling, effective for joining, coupling, connecting, linking, or attaching one slider head to another. In one embodiment, a slider head may comprise a male fitting, and a second slider head may comprise a female fitting, wherein the female fitting accommodates the males fitting and receives and/or couples with the male fitting. At least one of the slider heads is slideable along the opening of the container to open and close the container opening at will.

Figure 1:
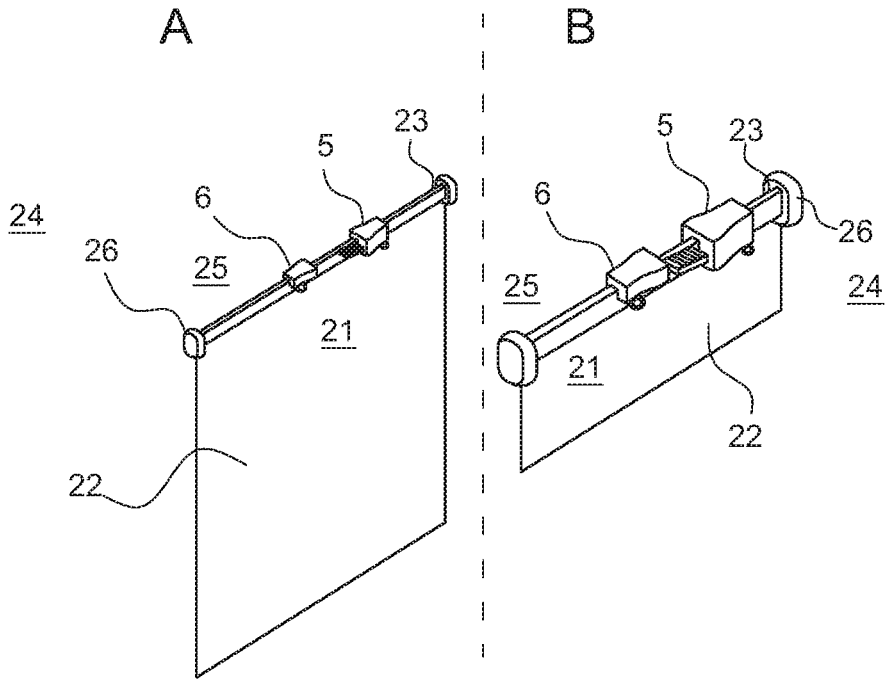
FIG. 1 illustrates an isometric view of an embodiment of a resealable, child-resistant container (A), and an enlarged view of a sealing system of the container (B) according to one embodiment of the disclosed invention.
Figure 2:
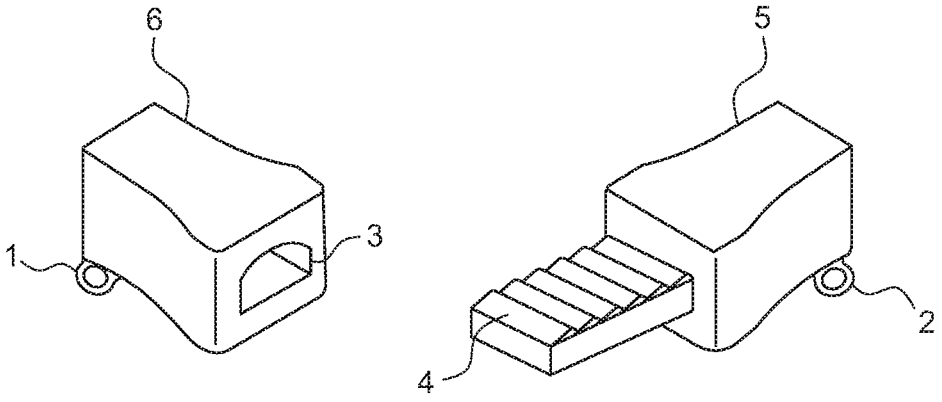
FIG. 2 shows an isometric view of an embodiment of slider head components of a sealing system; a slider head with a male fitting is shown on the right, and a slider head with a female fitting for receiving and coupling to a male fitting is shown on the left, according to one embodiment of the disclosed invention.
Figure 3:
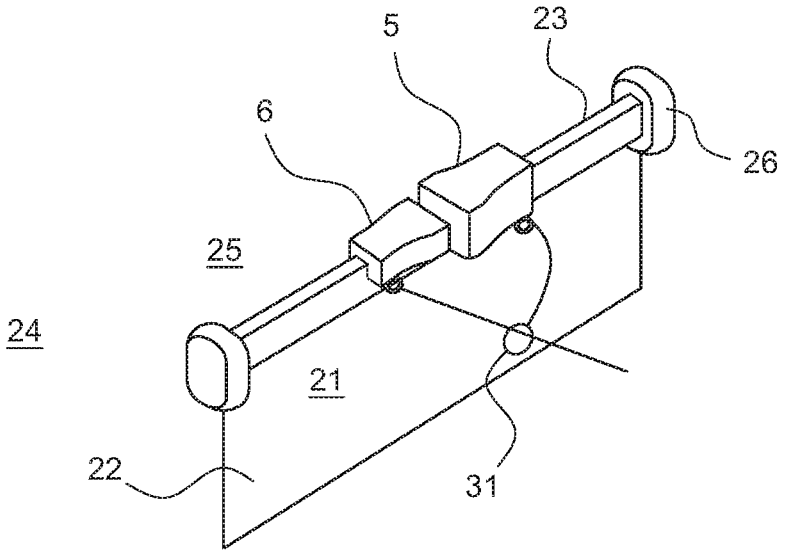
FIG. 3 shows an isometric view of an embodiment of a sealing system for a container with a tamper-indicating feature; in the illustrated embodiment, a tamper-indicating bridging attachment is coupled to attachment points on the first and second slider heads while the slider heads are engaged, according to one embodiment of the disclosed invention.

In a further embodiment, such as that shown with reference to FIGS. 1 to 3, the slider heads may oppose one another on the seal, allowing the slider heads to be drawn together, optionally coupling together, or when drawn apart, optionally uncoupling from one another. In another embodiment, drawing the slider heads together may interlock, engage, connect, couple, or join a container opening together such that the opening is sealed or closed. Drawing the slider heads apart may uncouple or otherwise separate the seal such that the opening is unsealed or opened. The mechanism through which the slider heads couple and/or uncouple the seal may be any mechanism effective for the specific seal used, as will be known to one of skill in the art.

The container sealing system may be a resealable container sealing system. The coupling of the slider heads may be a reversible coupling, allowing joined slider heads to be unjoined. Unjoining and drawing slider heads apart may re-open the container opening. The resealable container stealing system may be opened and closed as desired. In an embodiment, the method of uncoupling of slider heads may be any method effective or suitable for uncoupling the first and second fittings of the slider heads. In one embodiment, squeezing and/or lifting on one slider head while simultaneously pulling on the second slider head may disengage the two slider heads from one another. It will be recognized by one of skill in the art that any appropriate coupling mechanism for coupling the slider heads may have one or more associated effective methods for uncoupling and/or separating the slider heads.

In a further embodiment, the container sealing system may comprise one or more terminal caps located on the seal, which may restrict the movement of the slider heads such that they do not detach from the seal or the container.

In yet another embodiment, the container sealing system may comprise a tamper-indicating feature which indicates or otherwise signals an opening or attempted opening of the container.

In certain embodiments, the slider heads may further comprise one or more attachment points for a bridging attachment, and a bridging attachment may be attached or secured to or through at least one attachment point on the slider heads. In an embodiment, the bridging attachment may be attached to the slider heads while the slider heads are drawn, coupled, or joined together, which may optionally fasten the slider heads together. In one embodiment, the bridging attachment may be fixedly attached or otherwise part of at least one of the slider heads. Attachment of the bridging attachment while the slider heads are drawn, coupled, or joined together may enhance the child-resistant properties of the container sealable/resealable system.

In another embodiment, attachment of the bridging attachment while the slider heads are drawn, coupled, or joined together may produce a tamper-indicating container sealable/resealable system. In certain embodiments, opening or attempting to open the tamper-indicating container sealable/resealable system may trigger or otherwise cause an observable change in the tamper-indicating container sealable/resealable system. As will be recognized by those of skill in the art, an observable change may be any suitable change made to the bridging attachment, attachment points on the slider heads, or other component of the sealable/resealable container that can be detected. By way of example, opening a container sealable/resealable system from a closed state with an attached bridging attachment may require cutting or breaking the attached bridging attachment in order to unseal the resealable container by drawing the slider heads apart. Cutting or breaking of the bridging attachment may be observed as an indication or signal that the container sealable/resealable system has been opened, or an attempt has been made to open the container sealable/resealable system.

Further, the attachment points on the slider heads may be an opposing passage on each slider head. The passage on one slider head substantially aligned with the other so that when the slider heads are connected to each other, the passages allow for the bridging attachment to pass there through. The individual passages may form a continuous passage once the slider heads are connected or may form two separate substantially aligned passages. In such an embodiment, the bridging attachment may be a connector, for example a string, wire, cable or zip tie that passes through the two passages and is tied (in the event that a string is used) or locked to itself (in the event that a zip tie is used) such that cutting or breaking the bridging attachment is necessary to uncouple the two slider heads thereby providing a tamper indicating feature.

In one embodiment, there is provided a sealable or resealable container comprising a container as described herein and any sealable/resealable system as disclosed herein. The sealable or resealable container may comprise one or more sealable or resealable openings, and one or more compartments. The sealable or resealable container may by child-resistant and/or may comprise a tamper-indicating feature on at least one compartment. The sealable/resealable containers provided herein may be used for holding, storing, containing, or transporting one or more items, materials, or substances. In one embodiment, the items, materials, or substances may not suitable for handling or consumption by a child. Examples of container contents may include medication, household cleaners, money, or any other contents as needed.

It will be appreciated that the embodiments described herein are for illustrative purposes, and not intended to be limiting in any way.

Examples of a child-resistant, tamper-indicating, and/or resealable plastic bag container is described in further detail below with reference to FIGS. 1-25. These examples are provided as a non-limiting embodiment for illustrative purposes, and it will be understood that this example is not intended to be limiting in any way.

An example of an embodiment of a resealable, child-resistant container comprising an embodiment of a resealable container sealing system is illustrated in FIG. 1. In the example shown in FIGS. 1A and 1B, the resealable container (24) is a flexible, e.g., plastic bag (22) with an opening (21) having an attached container sealing system (25) comprising an interlockable seal (23) encompassing to the opening (21), a male slider head (5) coupled thereto, and a female slider head (6) coupled thereto and opposing the male slider head (5) along the opening of the container. The container sealing system (25) has terminal caps (26) which prevent the slider heads (5) and (6) from being removed from the interlockable seal (23).

The slider heads (5) and (6) of the container sealing system (25) are shown in more detail in FIG. 2. The female slider head (6) is shown on the left, and comprises a female fitting (3) suitable for receiving a male fitting, optionally comprising at least one or a plurality of wedge shaped barbs. The male slider head (5) is shown on the right, and comprises a male fitting (4) suitable for being received by the female fitting (3), optionally comprising notches for abutting the wedge optionally present in the female fitting (3). The slider heads (5) and (6) may further comprise an attachment point (1) and (2), respectively.

The resealable container (24) may be used to store any suitable item, material, or substance. In one embodiment, the sealable container may be used for storing an item, material, or substance that is not suitable for consumption or handling by a child or other person from whom access is not granted. After placing the item, material, or substance in the bag (22), the slider heads (5) and (6) may be drawn together such that the male fitting (4) is received by and coupled in a locked orientation to the female fitting (3). Drawing the slider heads (5) and (6) together has the effect of interlocking the interlockable seal (23) of the bag (22), sealing the resealable container (24). Squeezing and/or lifting one slider head while simultaneously pulling on the other slider head may uncouple the slider heads (5) and (6), unsealing the resealable container (24) as the slider heads are drawn apart from each other along the length of the interlockable seal (23), and allowing access to the contents therein. This process may be repeated to seal and unseal the resealable container (24) as needed.

As shown in FIG. 3, if a bridging attachment (31) is attached to the attachment points (1) and (2) on slider heads (6) and (5), respectively, the reseal able container (24) may be made more child resistant and/or may further comprise a tamper-indicating feature. A bridging attachment (31) may be used to further fasten and secure the slider heads (5) and (6) together, securing the resealable container (24) in the sealed state. Alternative to a fastening function, or in addition to a fastening function, the bridging attachment (31) may be used to indicate tampering with the resealable container (24). The bridging attachment (31) may be attached such that opening, or attempting to open, the resealable container (24) will cause an observable change in the resealable container (24). By way of example, opening a resealable container (24) in a closed state with an attached bridging attachment (31) for indicating tampering may require cutting or breaking the attached bridging attachment (31) in order to unseal the resealable container (24) by drawing the slider heads (5) and (6) apart. Cutting or breaking of the bridging attachment (31) may be observed as an indication or signal that the resealable container (24) has been opened or an attempt has been made to open the resealable container (24).

Figure 4:
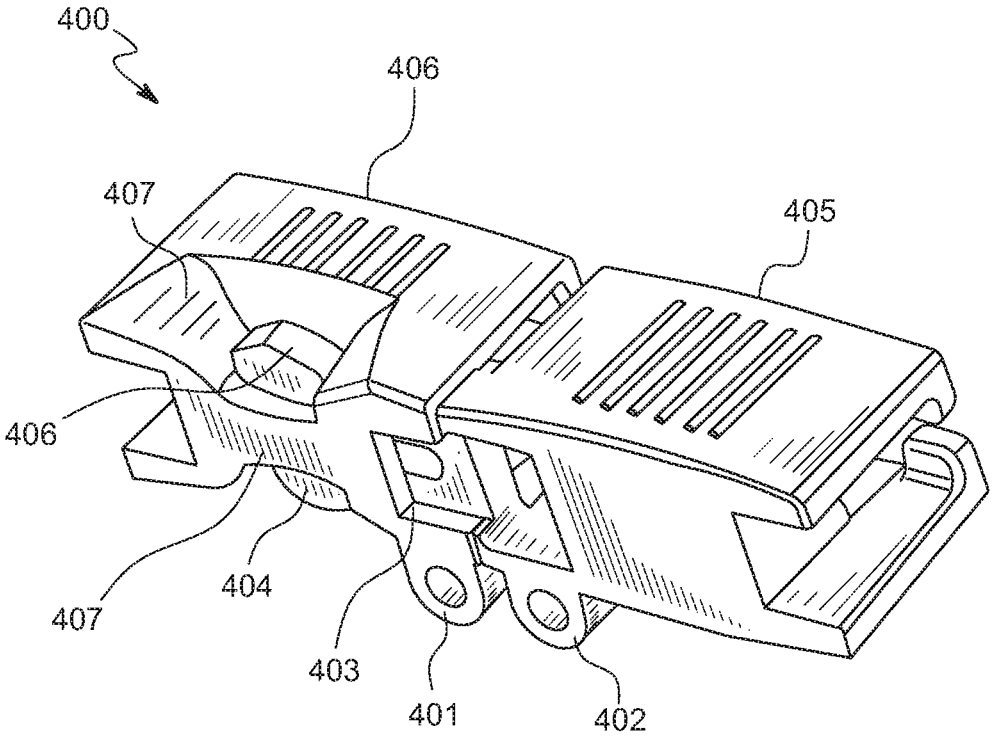
FIG. 4 shows a perspective view of the top of a sealing system for a container according to one embodiment of the invention.

FIG. 4 shows a perspective view showing the top, one side, and back of the sealing system for a container according to one embodiment of the invention. As illustrated in FIG. 4, a sealing device 400 comprises a first slider head with a male fitting 405 and a second slider head with a female fitting 406 wherein the male end 405 is operable to be inserted into the female fitting 406 as will be discussed. Both male 405 and female 406 ends contain locking restraints 401 and 402 (or attachment points). In the illustrated embodiment, locking restraints 401 and 402 may comprise a circular opening whereby a locking mechanism may be inserted through said openings. In one embodiment, the locking mechanism may comprise a barbed wire whereby tampering with said mechanism is required to separate male 405 and female 406 ends.

As illustrated, male fitting 405 contains at least two barbs 407. In one embodiment, barbs 404 may be actuated by pressing laterally (in a direction essentially perpendicular to interlocking seal of the bag) upon said barbs 404 simultaneously. That is, barbs 404 may be connected to male fitting 405 via a flexible connection allowing for simultaneous lengthwise (in a direction essentially in line with the interlocking seal of the bag) movement through channel 403 within the female fitting 406. Female fitting 406 comprises a receiver 407 for receiving the barbs 404 of male fitting 405. As illustrated in FIG. 4, receiver 407 may comprise a sloped surface containing an opening operative to receive and engage the barbs 404 in a locked orientation.

Figure 5:
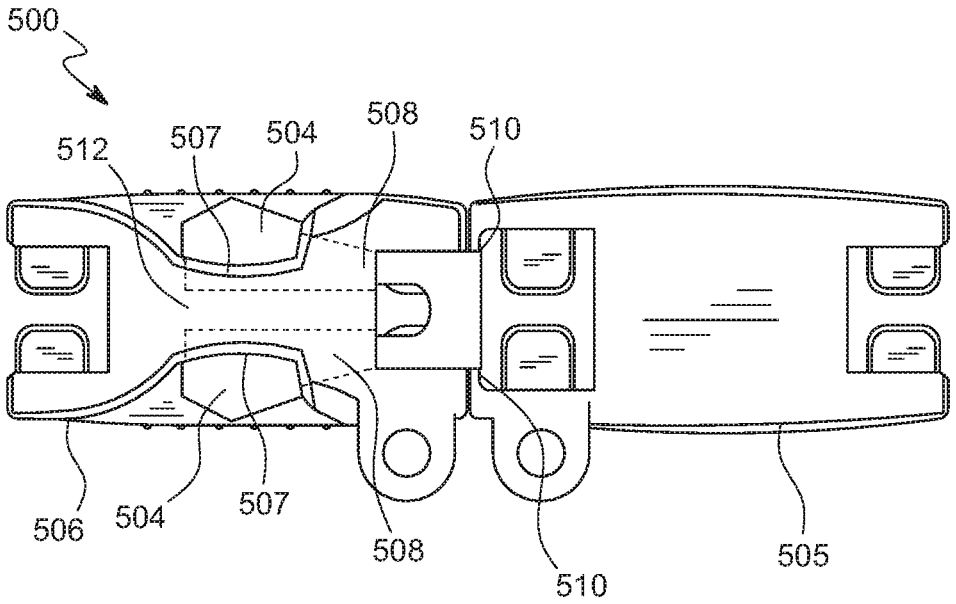
FIG. 5 shows a top view of a sealing system for a container according to one embodiment of the invention.

FIG. 5 shows a top view of a sealing system for a container according to one embodiment of the invention. As illustrated in FIG. 5, a sealing device 500 contains a male fitting 505 and a female fitting 506. The female fitting 506 comprises two receivers 507 (which are lateral openings that the bars 504 engage and protrude there from when in a locked orientation). As previously discussed, the male fitting 505 contains two barbs 504. As illustrated in FIG. 5, barbs 504 are each connected to the primary body of the male fitting 505 via flexible connectors 508. Flexible connectors may be fixed at a connection point 510 to the slider with the male fitting 505 thus allowing connectors 508 to move longitudinally (along the length of the interlocking seal of the container opening) to and from midpoint 512 within the slider head with the female fitting 506.

Figure 6:
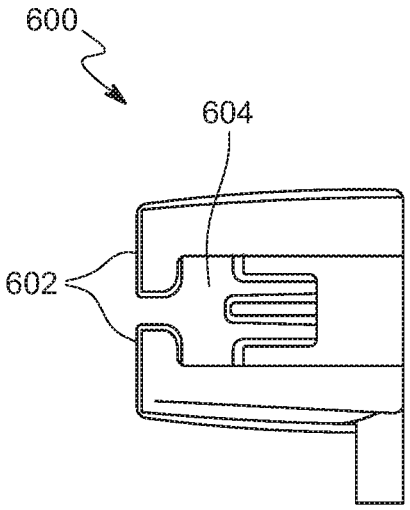
FIG. 6 shows a side view of a sealing system for a container according to one embodiment of the invention.

FIG. 6 shows a side view of a sealing system for a container according to one embodiment of the invention. As illustrated, the sealing device 600 contains a plurality of connecting terminals 602. Use of hooked connecting terminals 602 allow for the insertion of a container into empty space 604, more particularly the interlocking seal of the container into the space 604. In this manner, the device 600 locks in a lengthwise sliding arrangement to the interlocking seal of the container opening.

Figure 7:
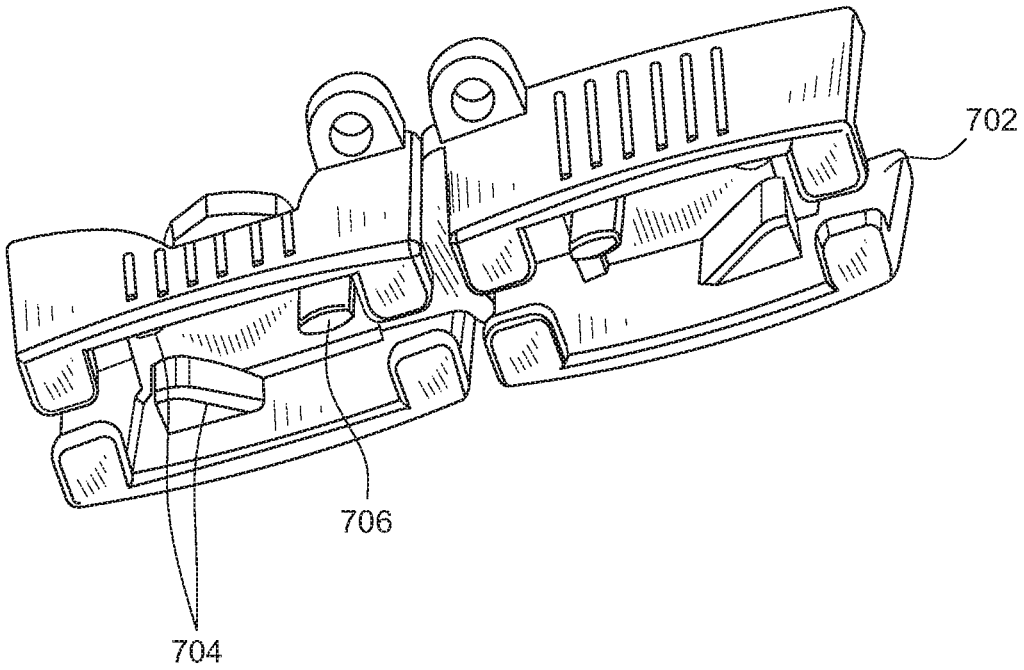
FIGS. 7-9 show bottom perspective views of a sealing system for a container according to one embodiment of the invention.
Figure 8:
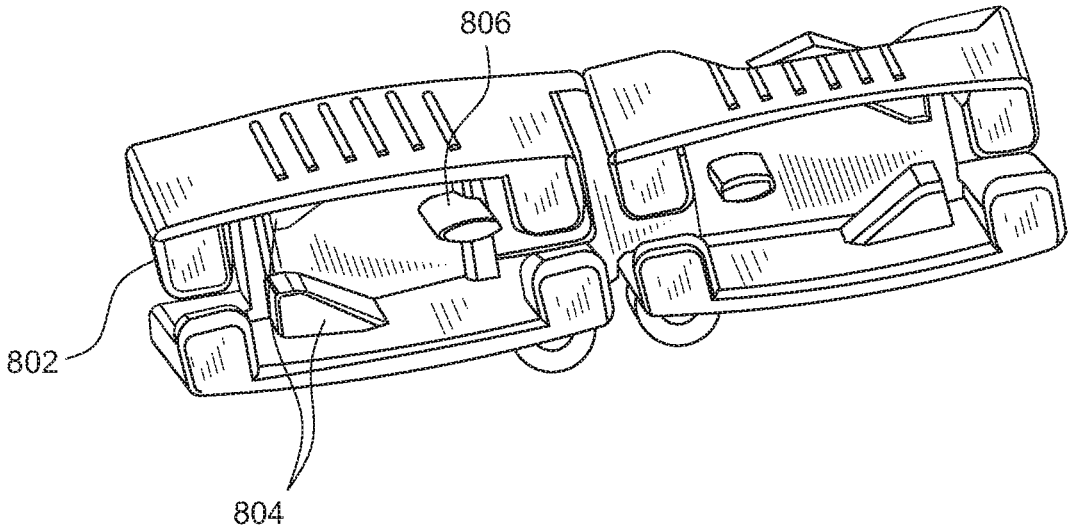
Figure 9:
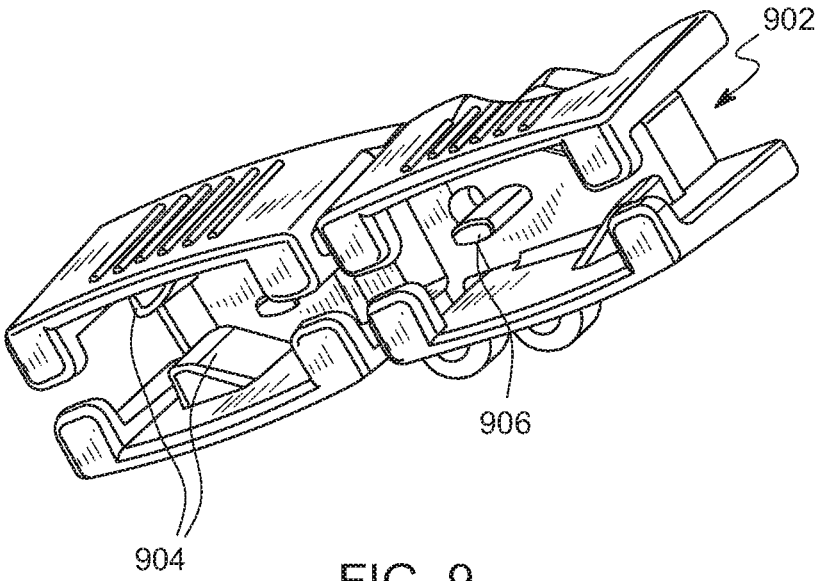
Figure 10:
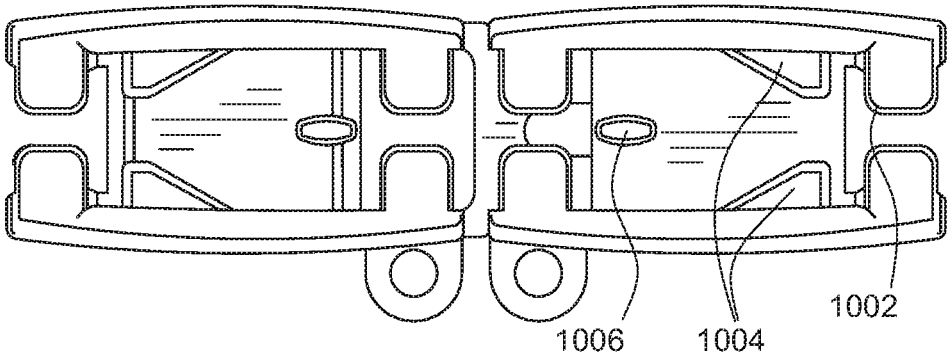
FIG. 10 shows a bottom view of a sealing system for a container according to one embodiment of the invention.
Figure 11:
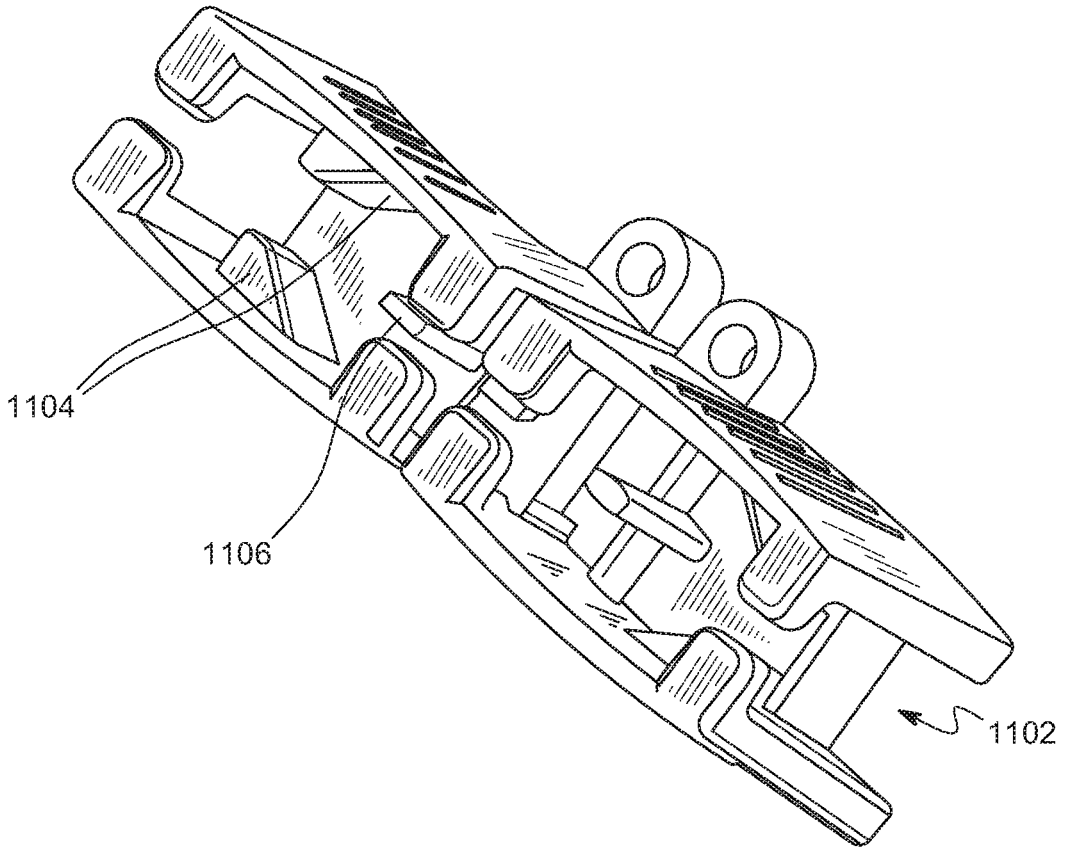
FIG. 11 shows a bottom perspective view of a sealing system for a container according to one embodiment of the invention.

FIGS. 7-9 show bottom perspective views of a sealing system for a container according to one embodiment of the invention. FIG. 10 shows a bottom view of a sealing system for a container according to one embodiment of the invention and FIG. 11 shows a bottom perspective view of a sealing system for a container according to one embodiment of the invention. As illustrated in the figures, the edge of an interlocking seal of a container opening may be inserted into opening (702, 802, 902, 1002, 1102). Sealant members (704, 804, 904, 1004, 1104) may be utilized to seal the opening upon the sliding of the device across said opening. That is, the opposing wedge shaped sealant members press the opposing interlocking seal of the container together as the slider heads are drawn together. Likewise, opener (706, 806, 906, 1006, 1106) may be operative to open said seal upon the movement of the ends in the opposite of direction of said sealing movement.

Figure 12:
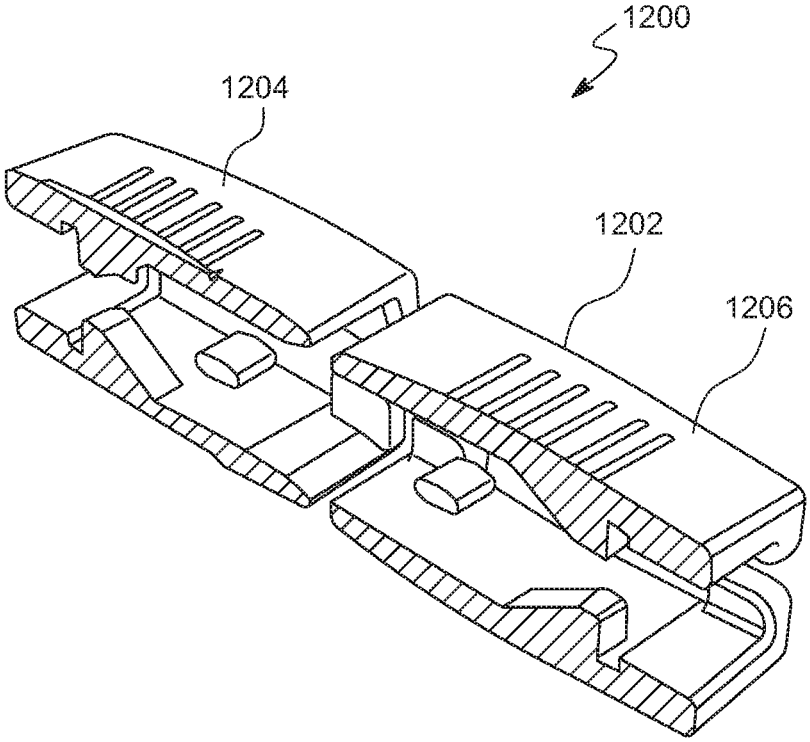
FIGS. 12-14 show perspective cross-sectional views of a sealing system for a container according to one embodiment of the invention.
Figure 13:
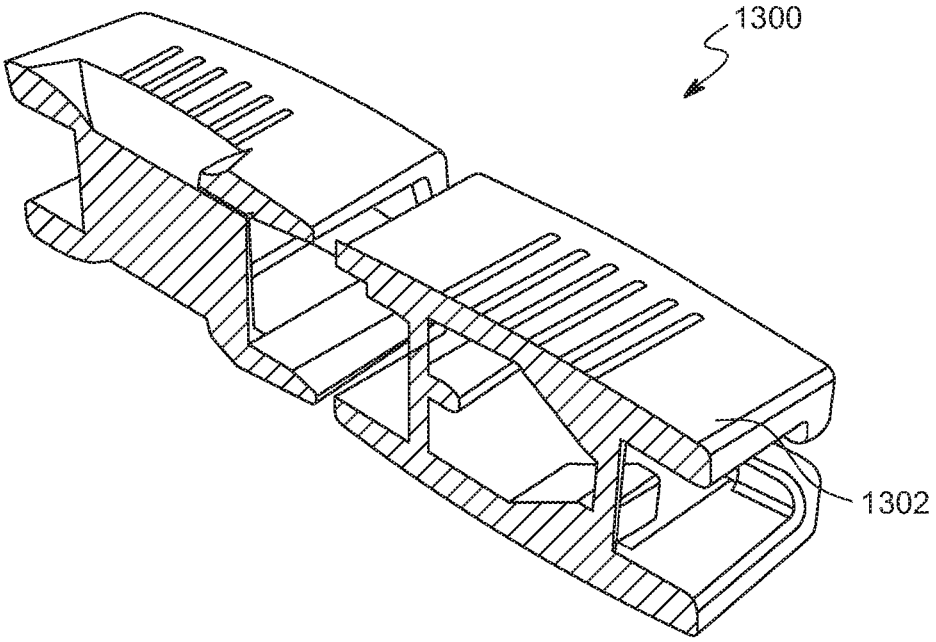
Figure 14:
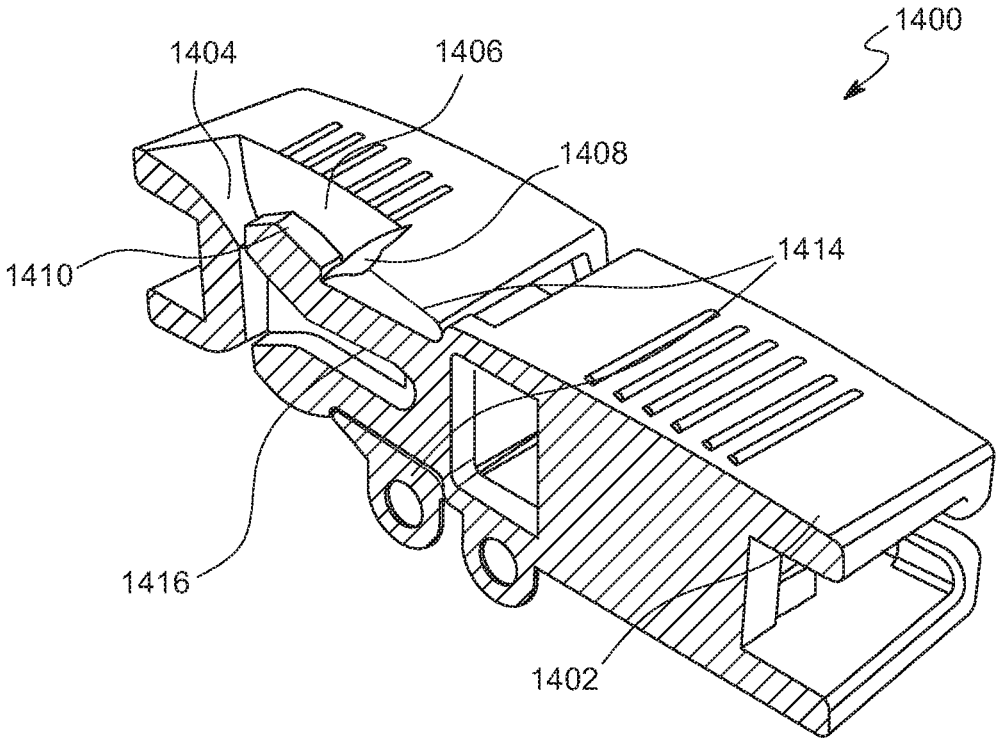

FIGS. 12-14 show perspective cross-sectional views of a sealing system for a container according to one embodiment of the invention. FIG. 12 illustrates a sealant mechanism for sealing containers such as plastic bags. As discussed previously, the device 1200 may connect to a container using side 1202. In one embodiment, a sealant side of a container such as a plastic bag may be inserted into the opening on side 1202. Ends 1204 and 1206 are then operable to slide lengthwise and seal the opening of the container. FIG. 12 illustrates a "closed" or "locked" position of the ends 1204 and 1206. In one embodiment, ends 1204 and 1206 may be positioned at the ends of a container opening (an "open position") allowing for contents to be inserted and removed. Ends 1204 and 1206 may then be moved to a position whereby at least one end is moved across the container opening thus closing and sealing the container. In one embodiment, the ends 1204 and 1206 may be symmetrically moved into a central position.

FIGS. 13 and 14 illustrate a locking mechanism for a device 1300, 1400 as discussed above. As illustrated in FIG. 14, a locking layer 1402 is deposited on top of sealant layer 1302 (FIG. 13). The female fitting contains a first, exterior ramp 1404, a receiver 1406 and an interior edge 1408. The combination of elements 1404, 1406, and 1408 form a receiver structure for receiving the barb 1410 of the male end. Upon sealing, barb 1410 is passed through channel which comprises a fixed width channel formed by edges 1414. In order to pass through the fixed channel, the barbs may simultaneously be depressed laterally towards midpoint 1416 and the heads slid lengthwise toward each other. In this manner, the barbs 1410 compress to meet the width of the fixed channel. Upon exiting the channel, the barbs 1410 are stopped by slope 1404 and may be released and expand into the receiver slot 1406 thus forming a lock whereby barbs cannot unintendedly pass back through the channel formed by edges 1414. A user may compress barbs 1410 laterally along midpoint 1416 and the head slid lengthwise in opposite directions thus passing the barbs 1410 back through the channel to reopen the sealed container.

Figure 15:
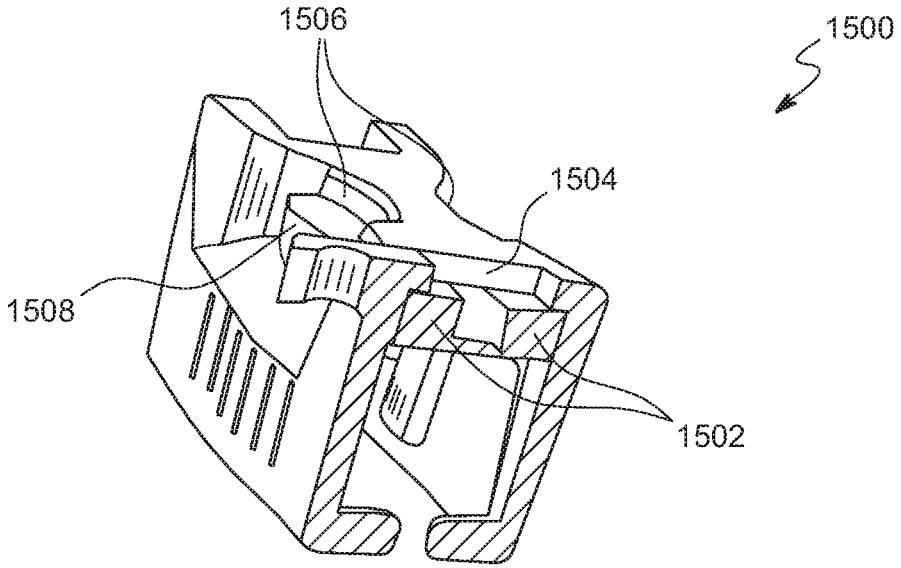
FIG. 15 shows perspective cross-sectional views of a female end of a sealing system for a container according to one embodiment of the invention.
Figure 16:
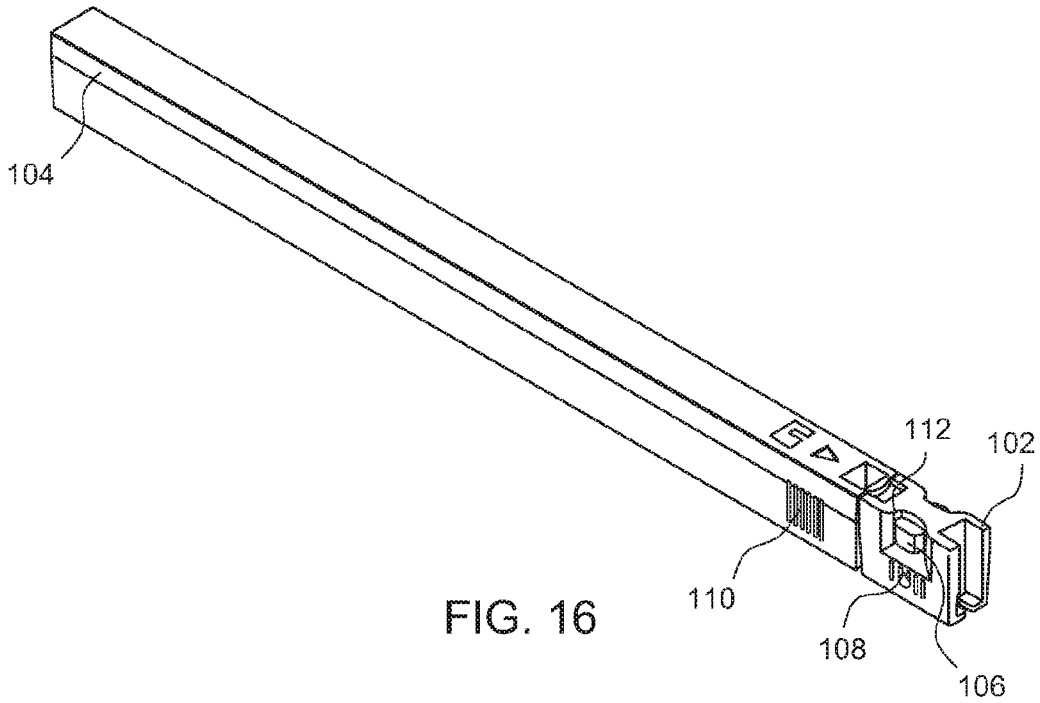
FIG. 16 shows a perspective view including the top, front and right views of a sealing system for a container according to another embodiment of the invention.
Figure 17:
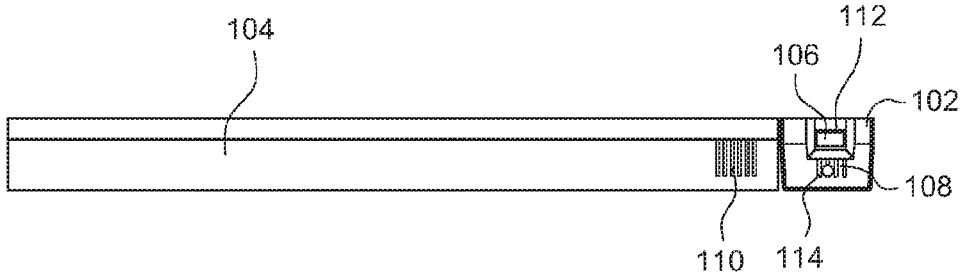
FIG. 17 shows a front view of the sealing system according to one embodiment of the invention.
Figure 18:
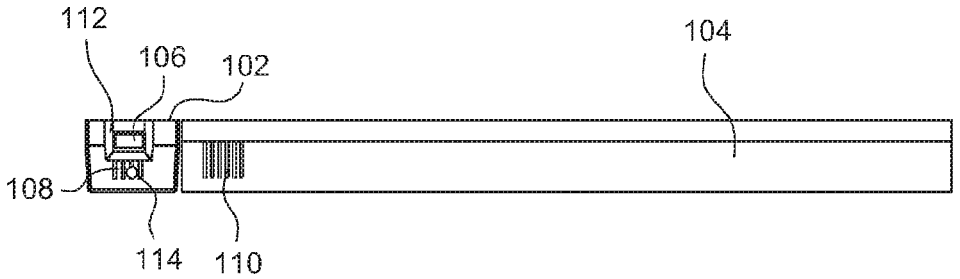
FIG. 18 shows a rear view of the sealing system according to one embodiment of the invention.
Figure 19:
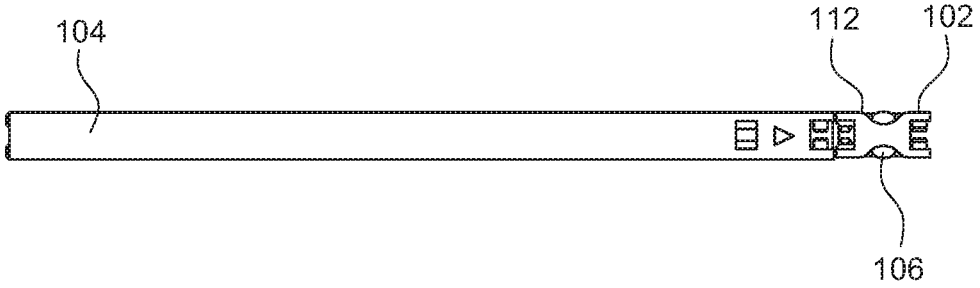
FIG. 19 shows a top view of the sealing system according to one embodiment of the invention.

FIG. 15 shows perspective cross-sectional views of a sealing system for a container according to one embodiment of the invention. As illustrated, a device 1500 contains flexible prongs 1502 and barbs 1508 which, as illustrated, are inserted into the channel 1504 and receiver slots 1506.

FIGS. 16-22 show various views of a sealing system according to at least one other embodiment of the invention. In this embodiment, the system includes a first slider head with a female fitting 102 and a second slider head with a male fitting 104 having an elongated structure extending lengthwise from at least one of the slider heads. The head with the female fitting 102 (in this embodiment, the head without the elongated structure) is preferably fixed at one end of the opening of the container. In this regard, the slider head with the male fitting 104 slides along the length of the interlocking seal of the container opening to engage and thus lock itself to the female fitting 102 that is fixed to the container opening. It is understood that the head with the male fitting may be fixed to the bag while the head with the female fitting has the elongated structure, and the invention is therefore not limited to this particular embodiment. The elongated structure is preferably dimensioned sufficiently to cover the entire opening of the container, i.e., the interlocking seal. This prevents one from accessing the contents of the container by simply pulling apart the structures of the interlocking seal of the container. In this embodiment, the male fitting 104 also includes a plurality of barbs 106 that engage the receiver(s) 112 of the female fitting 102. The slider heads 102, 104 may also include knurled surfaces 108, 110.

Figure 20:
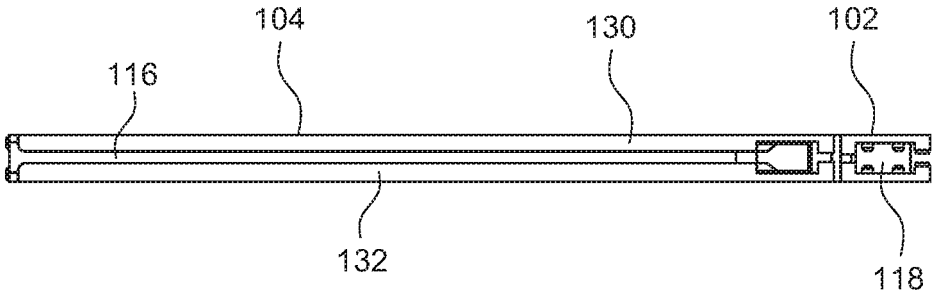
FIG. 20 shows a bottom view of the sealing system according to one embodiment of the invention.
Figure 21:
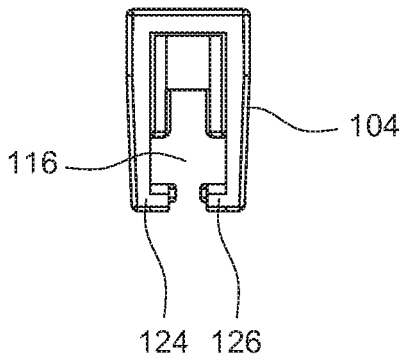
FIG. 21 shows a left view of the sealing system according to one embodiment of the invention.
Figure 22:
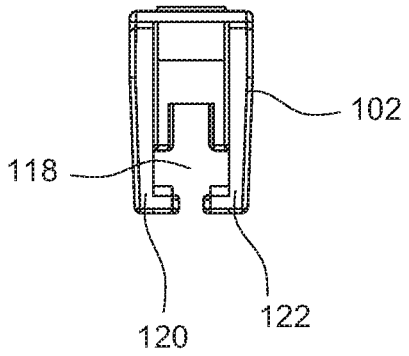
FIG. 22 shows a right view of the sealing system according to one embodiment of the invention.
Figure 23:
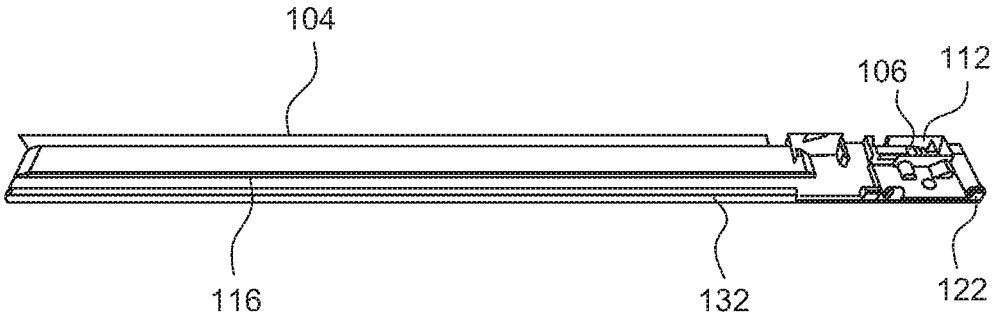
FIG. 23-25 show perspective cross-sectional views of the sealing system according to one embodiment of the invention.
Figure 24:
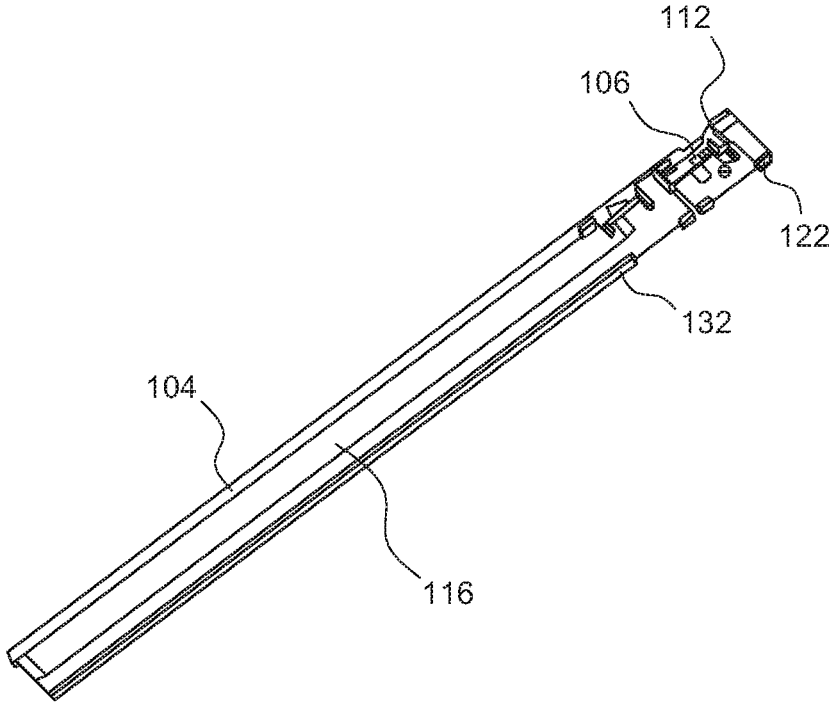
Figure 25:
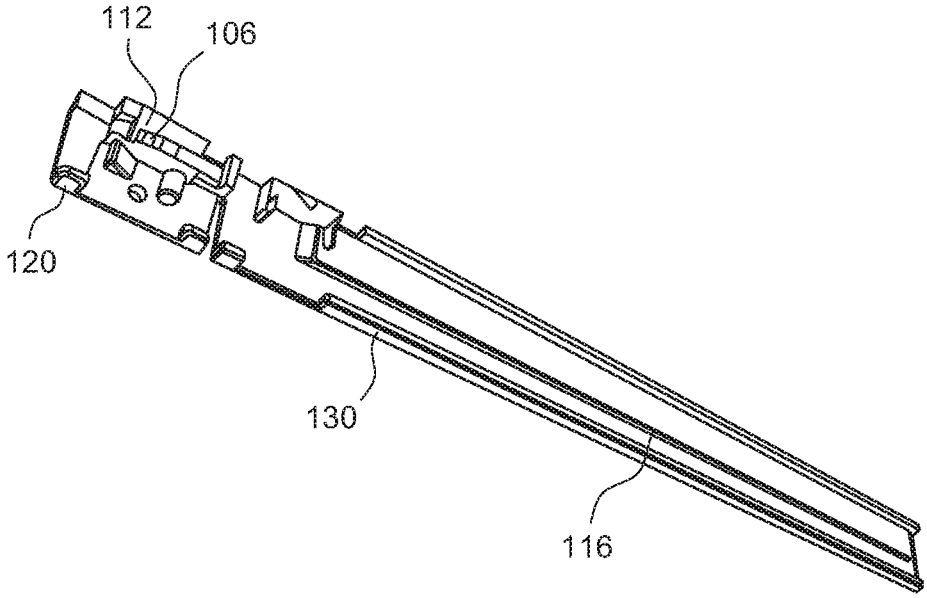

FIGS. 20 and 21-22 show a bottom and side views of the system, respectively. As can be seen, the slider head with the elongated male fitting 104 has a lengthwise slot 116 extending the length of the slider head 104. This slot receives the interlocking seal of the container and the connecting terminals 120, 122, 124, 126, 130, 132 retain the head in a sliding engagement to the interlocking seal of the container opening. A plurality of connecting terminals may be used on opposite sides of the walls of the slider head that define the slot therein to define a narrower lengthwise entry into slot 116. Moreover, the connecting terminals may extend essentially the entire length of the slider head or shorter portions thereon. The connecting terminals therefore retain the slider head 104 onto the container and keep the slider head 104 from being pulled upward and away from the container opening. In other words, the terminals prevent the head from moving in any direction except the lengthwise direction allowed as a result of the slot in the slider head 104. FIGS. 23-25 show cross sectional views of the system. As can be seen, the wedge shaped sealant members extend the length of the head with the male fitting 104 and are essentially parallel to the connecting terminals 120, 122, 124, 126, 130, 132.

It will be appreciated that modifications, obvious improvements and substitutions of various components is within the scope and spirit of the invention and should be considered to be within the scope of the appending claims.

What is claimed is:

1. A container sealing system comprising:

one or more seals encompassing a container opening, wherein the one or more seals are engageable to couple together to seal at least a portion of the container when activated;

a first slider head comprising a first fitting coupled to the one or more seals; and a second slider head comprising a second fitting coupled to the one or more seals and opposing the first slider head, wherein the first and second fittings interlock to prevent the first and second slider heads from moving away from each other lengthwise along the one or more seals;

wherein actuation of at least one of the slider heads such that the first fitting interlocks with the second fitting couples the one or more seals encompassing the container opening, thereby sealing the container when in a locked orientation; and wherein at least one of the first and second slider heads are slidingly coupled to the one or more seals;

wherein at least one of the slider heads comprises an elongated structure, and wherein the other of the slider heads is fixed at one end of the container opening, and wherein the elongated structure is dimensioned sufficiently to cover the opening in the container when in the locked orientation.

2. The container sealing system according to claim 1, wherein coupling of the first fitting to the second fitting is a reversible coupling, and the container sealing system is a resealable container sealing system.

3. The container sealing system according to claim 1, further comprising a tamper indicating feature including a bridging element which indicates an occurrence of opening of the container.

4. The container sealing system according to claim 1, wherein at least one of the fittings is a male fitting comprising at least one barb that interlocks with a corresponding female fitting.

5. The container of claim 1, wherein the slider head with the elongated structure has a lengthwise slot therein that receives the one or more seals of the container.

6. The container sealing system of claim 5, wherein the elongated structure further comprises a plurality of connecting terminals that retain the slider head with the elongated structure in sliding engagement to the one or more seals of the container.

7. The container sealing system of claim 6, wherein at least one of the connecting terminals extends along a length of the slider head with the elongated structure.

8. The container sealing system of claim 7, wherein the at least one connecting terminals is essentially parallel to the slot in the slider head with the elongated structure.

9. The container sealing system of claim 5, wherein the slider head with the elongated structure comprises at least one sealant member located within the slot of the elongated structure.

10. The container sealing system of claim 9, wherein the at least one sealant member has a wedge shape that extends lengthwise along the elongated structure.

11. The container sealing system of claim 9, wherein the slider head with the elongated structure comprises a plurality of sealant members that extend lengthwise along the elongated structure.

12. The container sealing system of claim 11, wherein the plurality of sealant members are essentially parallel to each other.

13. The container sealing system of claim 11, wherein the plurality of sealant members define a narrower lengthwise entry into the slot.

14. The container sealing system of claim 1, wherein the container is a flexible bag.

15. A container sealing system comprising:

one or more seals encompassing a container opening, wherein the one or more seals are engageable to couple together to seal at least a portion of the container when activated;

a first slider head comprising a first fitting coupled to the one or more seals; and a second slider head comprising a second fitting coupled to the one or more seals and opposing the first slider head, wherein the first and second fittings reversibly interlock to prevent the first and second slider heads from moving away from each other lengthwise along the one or more seals;

wherein at least one of the fittings is a male fitting comprising at least one barb that interlocks with a corresponding female fitting;

wherein at least one of the slider heads comprises an elongated structure having a lengthwise slot therein that receives the one or more seals of the container and a plurality of connecting terminals that retain the slider head with the elongated structure in sliding engagement to the one or more seals of the container, and the other of the slider heads is fixed at one end of the container opening, and wherein the elongated structure is dimensioned sufficiently to cover the opening in the container when in the locked orientation;

wherein actuation of at least one of the slider heads such that the first fitting interlocks with the second fitting couples the one or more seals encompassing the container opening, thereby sealing the container when in a locked orientation; and wherein at least one of the first and second slider heads are slidingly coupled to the one or more seals.

16. The container of claim 15, wherein at least one of the connecting terminals extends along a length of the slider head with the elongated structure.

17. The container of claim 16, wherein the at least one connecting terminals is essentially parallel to the slot in the slider head with the elongated structure.

18. The container of claim 15, wherein the slider head with the elongated structure comprises at least one sealant member located within the slot of the elongated structure.

19. The container of claim 18, wherein the at least one sealant member has a wedge shape that extends lengthwise along the elongated structure.

* * * * *